United States Patent [19]

Lott

[11] Patent Number: 4,644,890

[45] Date of Patent: Feb. 24, 1987

[54] TRIMARAN WITH PLANING HULL

[76] Inventor: David A. Lott, Rte. 2 Box 55, Broxton, Ga. 31519

[21] Appl. No.: 708,279

[22] Filed: Mar. 5, 1985

[51] Int. Cl.[4] ..... B63B 1/20

[52] U.S. Cl. ..... 114/61; 114/290

[58] Field of Search ..... 114/56, 57, 61, 123, 114/263, 266, 267, 345, 357, 288, 290, 289, 292; 441/40, 44–46, 50, 53; D12/310–312, 314

[56] References Cited

U.S. PATENT DOCUMENTS

| | | | |
|---|---|---|---|
| 3,148,652 | 9/1964 | Canazzi | 114/290 |
| 3,602,179 | 8/1971 | Cole | 114/290 |
| 3,807,337 | 4/1974 | English et al. | 114/61 |
| 3,937,164 | 2/1976 | Austin | 114/288 |
| 3,996,869 | 12/1976 | Hadley | 114/61 |
| 4,091,761 | 5/1978 | Fehn | 114/61 |

*Primary Examiner*—Sherman D. Basinger
*Assistant Examiner*—Stephen P. Avila
*Attorney, Agent, or Firm*—V. L. Leon; Harry I. Leon

[57] ABSTRACT

A hull for a boat having a forward section with two twin subhulls or sponsons joined by a bridging structure which forms, approximately midway along the sponsons, the fore-end of a third subhull. The twin forward subhulls each have a modified W cross-sectional shape which is continued to a spoiler located near the mid-section of the hull. Water flowing past the undersides of the sponsons gives rise to a lifting action as the boat starts to move. The bottom of the central subhull runs downward and rearward between the sponsons but remains separated from them past the spoilers. In the rear section, the extension of the central subhull is deeper than the remainder of the hull and has a substantially flat bottom joined to sides inclined outwardly and upwardly to form a generally V cross-sectional shape. As the boat picks up speed, it merely rises in the water with little change of attitude until the aft part of the hull skims on the surface of the water. The combination of the W-shaped undersides of the sponsons and the mid region of the hull in which the sponsons are gradually merged with the central subhull gives rise to a smooth transition from a floating to a planing mode; and this transformation is accomplished at a relatively low speed.

5 Claims, 15 Drawing Figures

TRIMARAN WITH PLANING HULL

SUMMARY OF THE INVENTION

This invention relates to boat hulls having two subhulls providing a catamaran-type structure and an additional subhull, a portion of which is formed symmetrically between and in juxtaposition with the side subhulls.

It is among the objects of the invention to provide a general purpose, high performance boat hull having the several characteristics of good stability, longitudinal, lateral, and directional; capacity for achieving relatively high speeds at low power; maneuverability including a narrow turning radius; the capacity to recover quickly after traversing a wake; and an adequate displacement to carry twenty people safely on a 24 foot hull.

The hull comprises twin forward sponsons which are easily lifted out of the water at higher speeds due to a combination of effects while incurring only a small change in the attitude of the boat. An important feature is the shape of the bottom surface of each sponson which is that of a modified W cross section so that water flowing past its underside gives rise to a lifting action. Approximately midway between the stern and bow, the fore-end of a third subhull is formed in the region between the forward sponsons. The concave bottom surfaces of the sponsons gradually flatten out at the same time this third subhull increases in depth. A further important feature is the configuration of the third subhull as it extends downwardly and rearwardly in the space between the sponsons and rearward of them. A pair of tunnels formed on either side of the central subhull between it and the sponsons each has a venturi throat which tends to suck the mid section of the hull into the water as the forward sponsons are lifted out of it due to the planing action. The result is a hull which exhibits a smooth transition from a stationary mode to a planing mode of operation and which allows this transformation to be accomplished at relatively low speeds. Moreover, the suction force of the venturi throats helps to dampen out waves and other disturbances in the water and to prevent the boat from rocking more than one oscillation at planing speeds.

Aft of each sponson, a shallow keel or fin protrudes downwardly from a generally flat side wall which is inclined upwardly and outwardly at a small angle from the flat bottom wall, the fin diverging from the centerline of the hull rearwardly. These two fins not only serve to dampen waves but also to divert water disturbed by the central subhull and the two sponsons away from the stern and to provide stability for the craft during turns.

Another object of this invention is to provide a hull for a boat which fills a gap between pontoon-type boats and cruisers and which has superior handling and performance characteristics making it suitable alternately for carrying large numbers of partygoers and for towing slalom skiers.

BRIEF DESCRIPTION OF THE DRAWINGS

Further details are explained below with the help of the examples illustrated in the attached drawings in which.

Like reference characters indicate corresponding parts throughout the several views of the drawings.

DESCRIPTION OF THE PREFERRED EMBODIMENT

Figure 1:
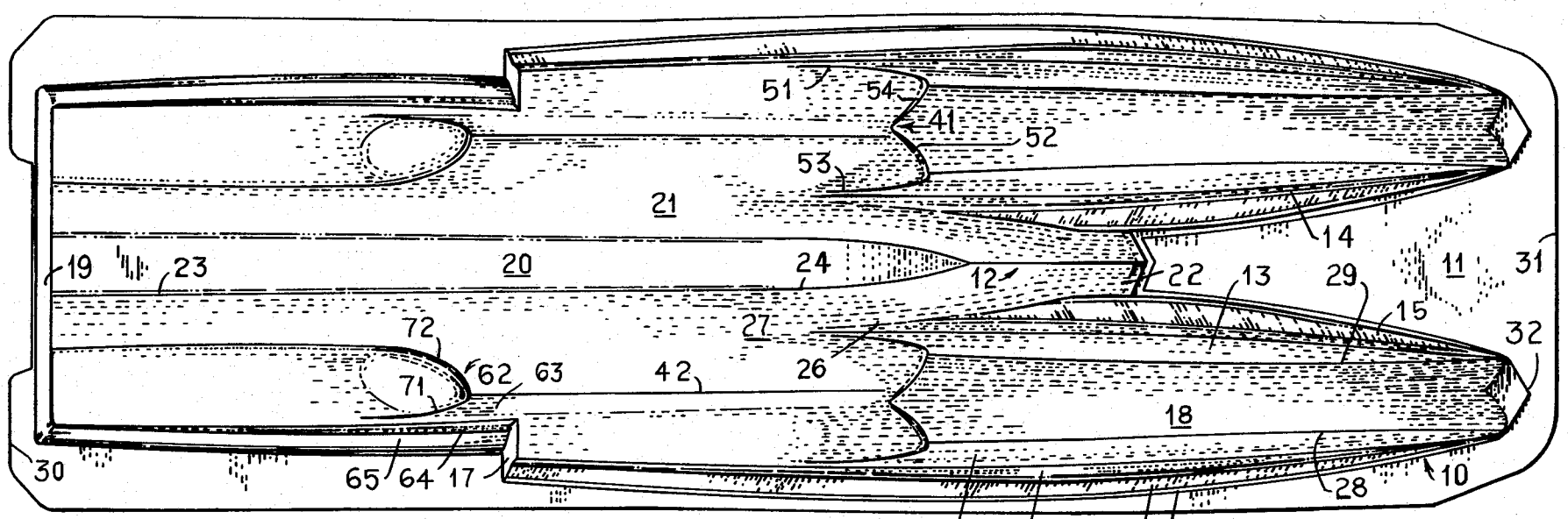
FIG. 1 is a bottom plan view of a hull according to the present invention.

The boat hull disclosed herein is preferably a one-piece molding formed from some suitable structural plastic material. However, the hull may be constructed of various materials and by many methods known to those skilled in the art since the precise method or material employed constitutes no part of this invention. Braces (not shown) are provided in the bottom of the hull to enable it to withstand the forces of impact upon hitting waves at speeds as high as 70 mph.

The boat hull embodying this invention is generally symmetrical in cross-sectional shape; and for clarity purposes, reference numbers of the detailed drawings are noted on only half of the hull structure details except where required in the following description. The intersection of a vertical plane bisecting the hull longitudinally with the plane of a transverse cross-section is shown as a dashed line denoted by the reference character 5' in the figures.

Referring to FIG. 1, the boat hull comprises a pair of laterally spaced sponsons, generally indicated at 10, a bridge structure 11 spanning between them, and a central subhull, generally indicated at 12, which extends rearwardly and downwardly from the structure 11, with the fore part of the central subhull being formed between and in juxtaposition with the sponsons.

As illustrated in the figures, the hull includes outboard surfaces 33, 34, 35, 36, 37 extending generally from a prow 32 of each sponson 10 to a rearwardly facing step 17 for approximately two-thirds the length. The outboard surfaces 33 and 34, 34 and 35, 35 and 36, 36 and 37 are joined to form chine lines 43, 44, 45 and 46, respectively, which extend from aft of the prow to the step. Rearward of this step 17, the outboard surfaces 63 and 64, 64 and 65, 65 and 66, 66 and 67 are joined to form chine lines 73, 74, 75, 76, respectively, which extend from the step towards the transom wall 19.

Inboard surfaces 13, 14, 15 and 16 extend from near the prow 32 of each sponson 10 and are joined to form chine lines 47, 48, and 49, respectively. The lines 47, 48, 49 fair into a side wall 21 of the central subhull 12, with the lowermost chine line 47 being the longest and having a length approximately two-fifths that of the hull. A concave underside 18 having a pair of dual forward keel edges 28, 29 also extends downwardly and rearwardly from the prow 32 for approximately 40% of the hull length. The keel edges 28, 29 are the lower boundaries of the outboard surface 33 and the inboard surface 13, respectively.

Figure 2:
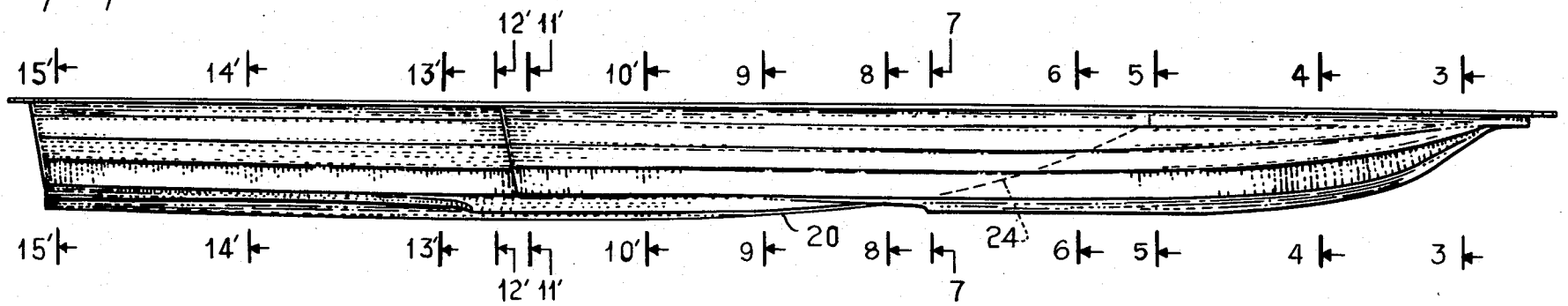
FIG. 2 is a side elevational view of the hull.
Figure 3:
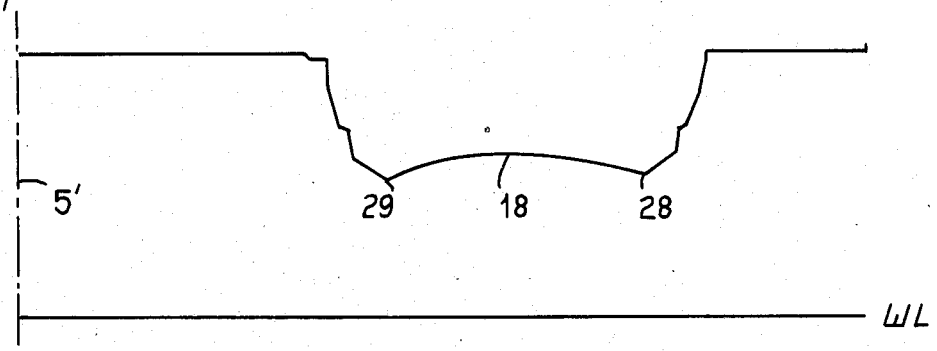
FIGS. 3 through 15 are enlarged half station or transverse sectional views taken generally along lines 3—3 through 15'—15' of FIG. 2, all being simplified to eliminate structure and show only the outside envelope of the hull.
Figure 4:
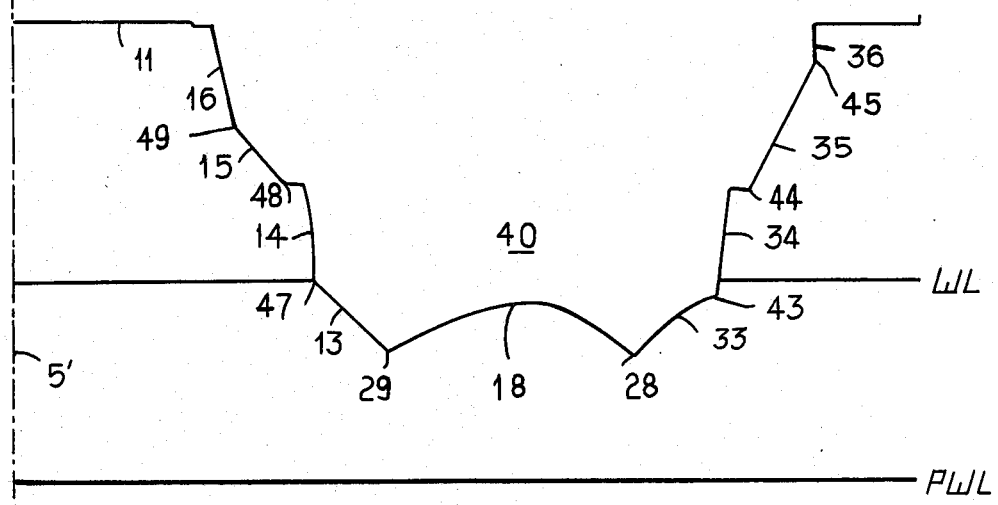
Figure 5:
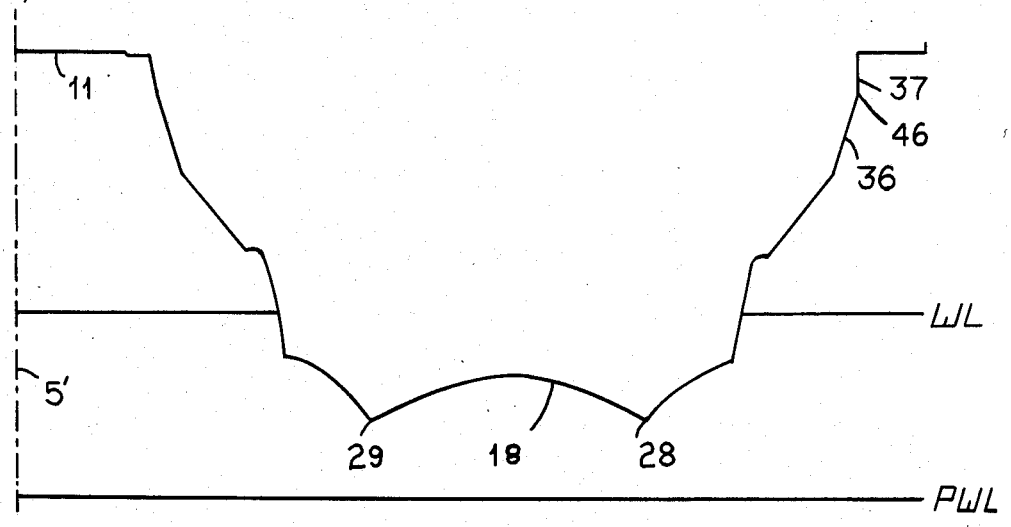

As shown in FIGS. 1 and 3 through 7, the underside 18 fairs into a minimal keel width at approximately one-third the length of a sponson from its prow. This minimal keel width is in the same region as that in which the concavity of the underside 18 is most pronounced. As is best seen in FIGS. 1, 2 and 3, the underside 18 which is part of a modified W cross-sectional form 40 extends above the load water line level of the hull denoted approximately by the parallel lines designated by the legend WL. When operating as a displacement hull, the form 40 scoops and entraps air bubbles between the underside 18 and the water level to reduce surface to water friction. The section of the underside 18 with the highest degree of concavity of those illustrated in the figures (FIG. 4) has approximately the same cross-sectional area as do the transverse cross-sections shown in FIGS. 5 and 6. The change in the degree of concavity of the transverse sections of the underside 18 provides a channel of approximately uniform cross-sectional area along a large portion of the mid region of the underside 18 before it is flattened forward of the spoiler 41 along with a substantial reduction in the size of this channel. Thus the rate at which air is forced aft beneath the sponsons to provide a lift remains substantially constant as the leading edge at which the sponsons contact the water progresses along their mid sections towards the stern. This feature enhances the smooth, kickless take-off of the hull exhibited as it begins to plane. I have also found empirically that if the concave undersides of the sponsons are extended too far toward the stern, the sponsons tend to grab the water, causing the boat to dart about and react with an oscillatory motion to waves in rough water at planing speeds. By contrast, my preferred hull under similar conditions gives a smooth and stable ride because the general flattening out of this hull rearward of the undersides 18 of the sponsons helps to integrate the water surface, dampening oscillations.

Further, I have observed that the hull rises faster with the sponsons having the W cross-sectional form 40 than would be the case if they were rounded. Moreover, the usual tendency of a planing hull to nose up when power is applied or increased has been substantially overcome. In fact, the angle between the deck line of my hull and the water line is typically only about 1.8° at the onset of the planing mode. By way of example, in a full-size test boat having a deck length of 24 feet, the bow is raised no more than 9 inches to a horizontal plane passing through the stern or about 4.5 inches relative to the water line.

In FIGS. 3 through 15, two parallel lines have been drawn, one designated by the legend WL and the other by the legend PWL, and are supposed to indicate the approximate water lines while the boat is stationary in the water and at the onset of the planing mode, respectively. The position of each line WL corresponds to a boat employing the hull having a draft of approximately 8 inches; in practice, a full size test boat with this hull has been found to have a draft of 8 to 10 inches depending upon the size of the outboard motor (not shown). It will be noted that in FIGS. 7 through 15, the lowermost surface of the hull is clearly within the water and is well below the water line WL. At planing speeds, each portion of the hull has risen relative to the surface of the water.

Figure 6:
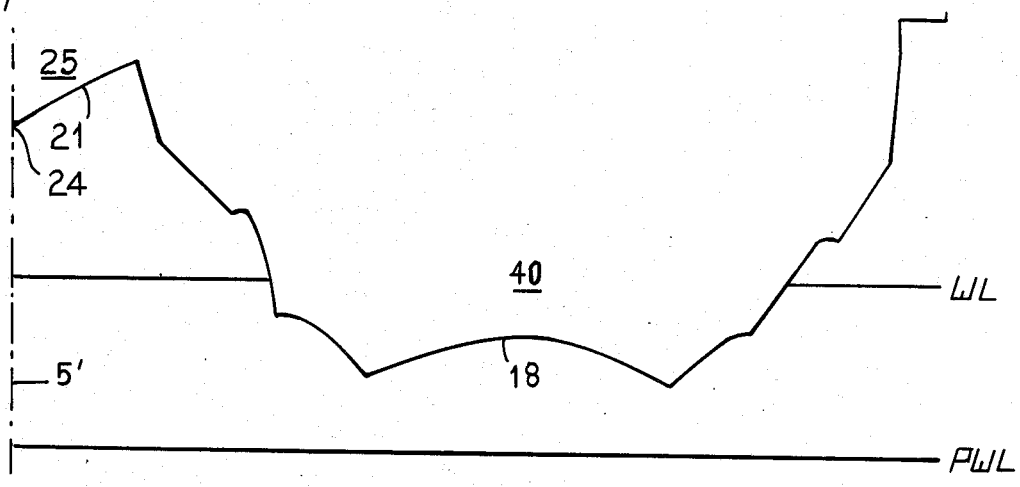
Figure 7:
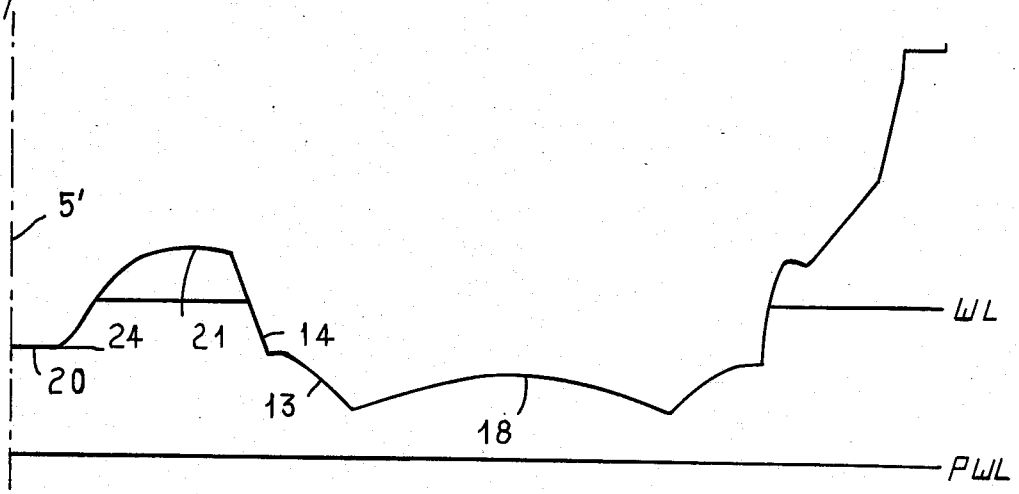
Figure 8:
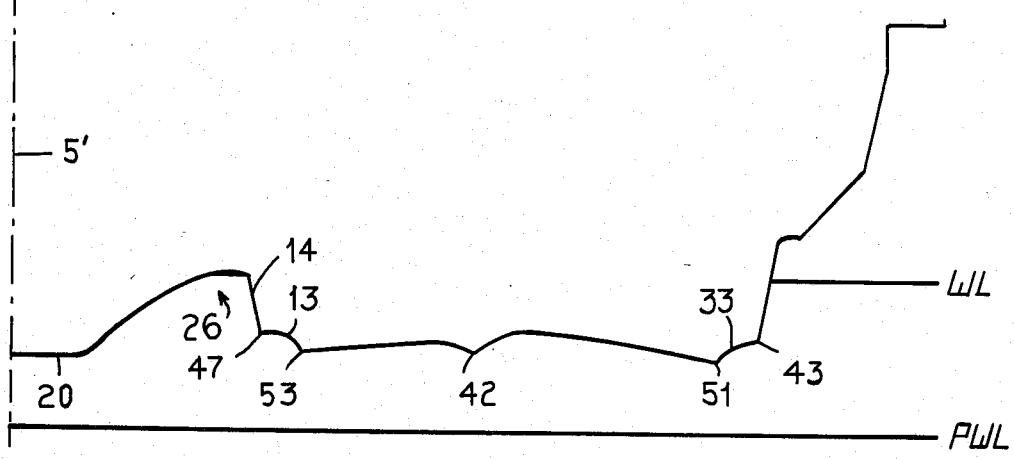
Figure 9:
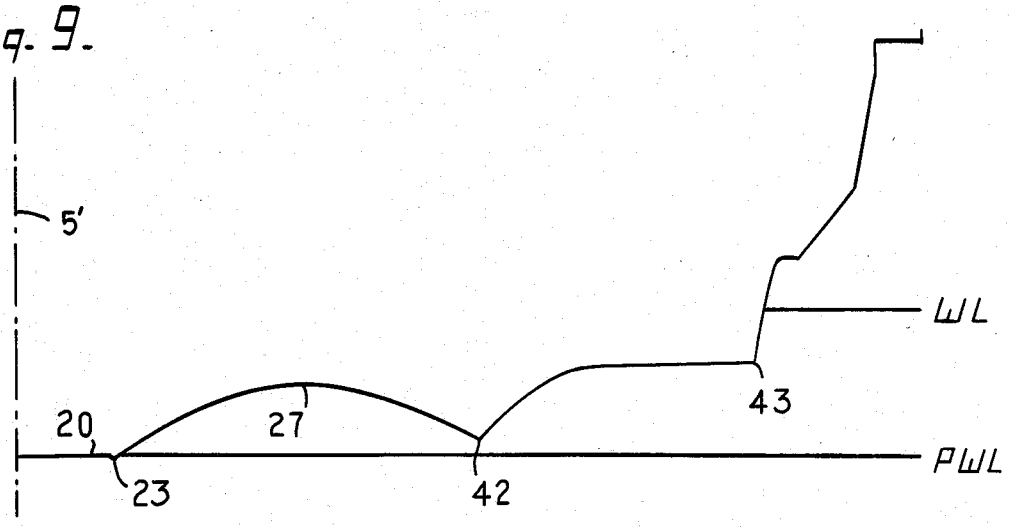
Figure 10:
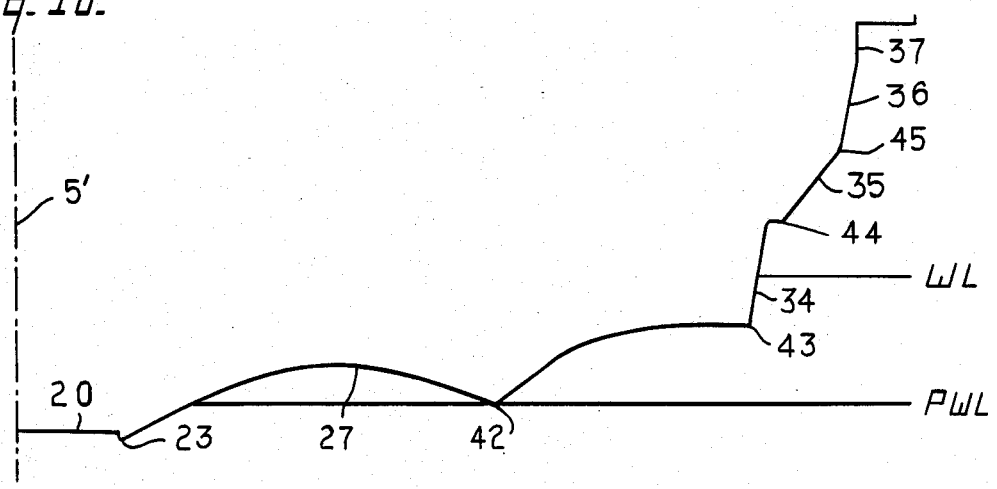
Figure 11:
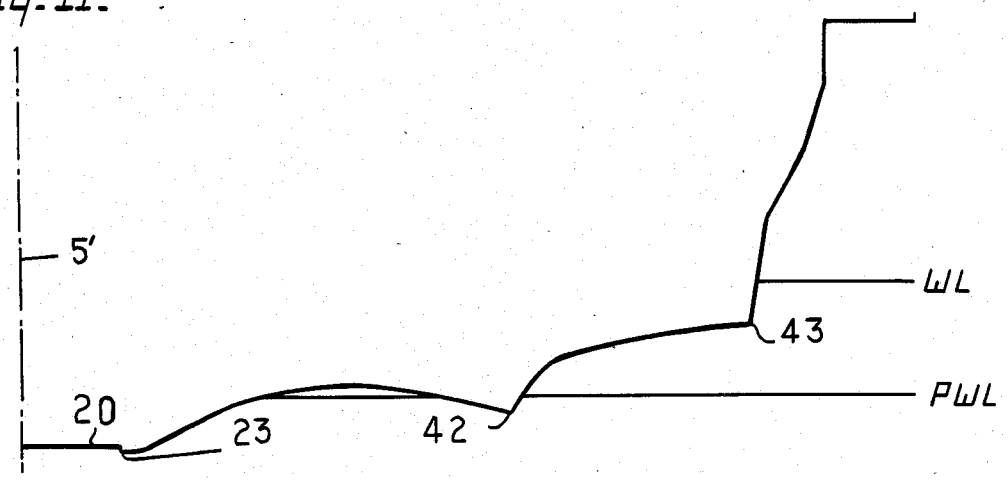
Figure 12:
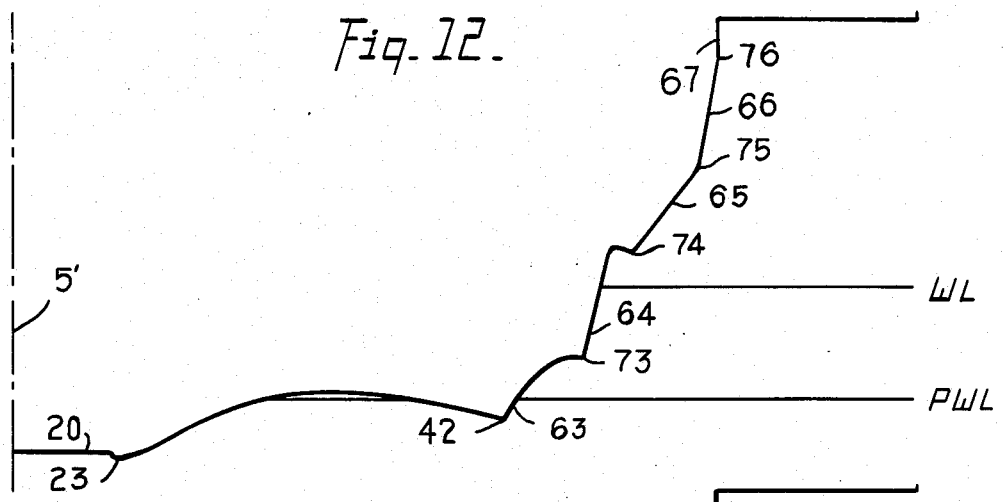
Figure 13:
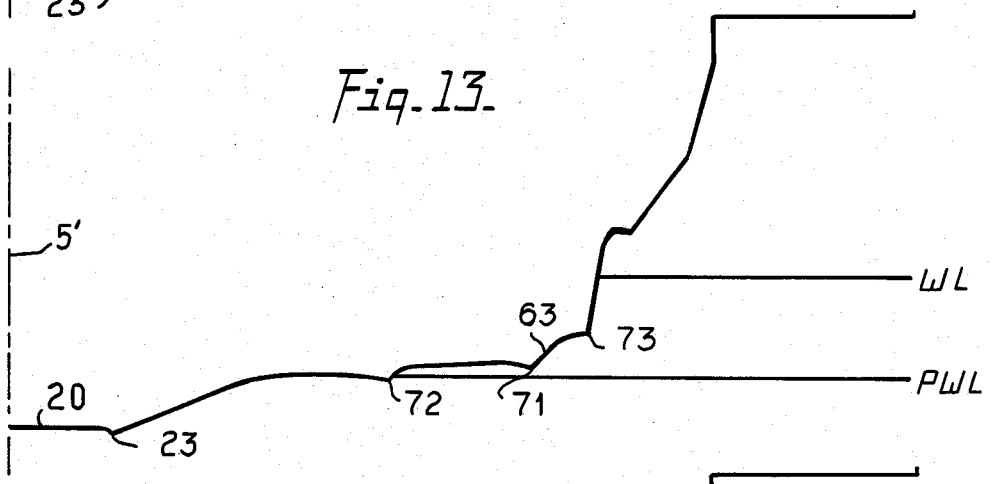
Figure 14:
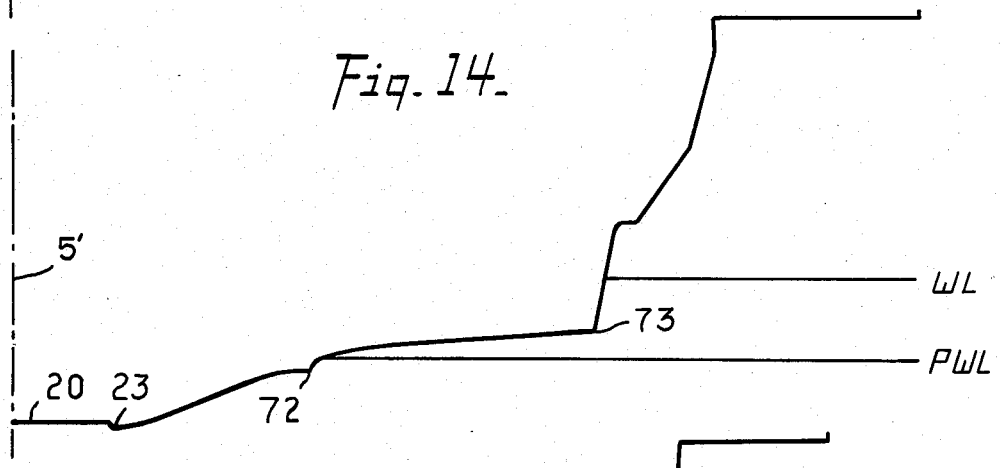
Figure 15:
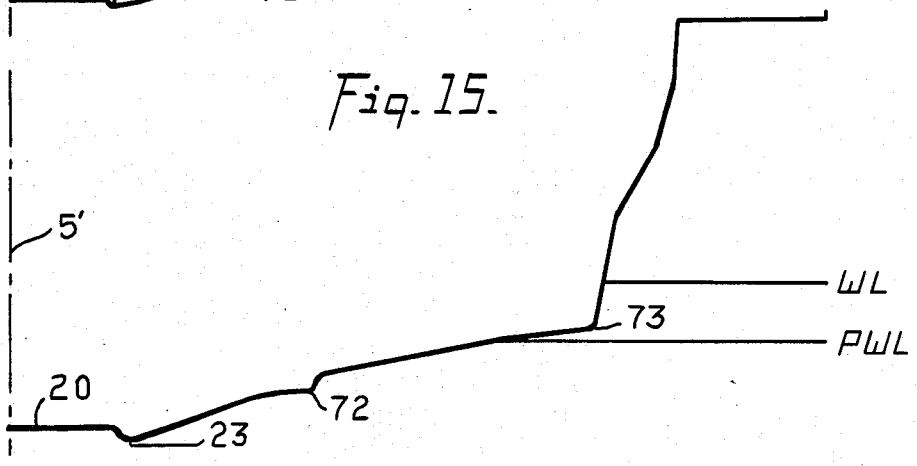

Referring to FIGS. 1, 2, and 9 through 15, a bottom wall 20 of the aft part of the hull runs substantially parallel to the waterline for approximately one-half the length from the stern forward, then has a gradually increasing upward sweep towards a fore-end 22 of the subhull 12. A rear keel edge 23 formed on either side of the wall 20 starts at an elevation slightly below that of the wall 20 and merges with a chine line 24 which is approximately even with this wall along its rise toward the fore-end. The chine lines 24 converge aft the fore-end 22 as the side walls 21 of the subhull 12 form a V section 25. As illustrated in FIGS. 6, 7, and 8, the inboard surfaces 13, 14 of the sponsons and the side walls 21 of the central subhull, as well as the bottom wall 20, form a tunnel of decreasing cross-section from the fore-end 22 toward the stern 30. Forward of this tunnel, air is scooped in between the bottom surface of the bridging structure 11 and the walls 13, 14, 15, and 16 of the sponsons. This air is compressed and exerts an upward pressure or lift against the upper portions of the wall 21 and surfaces 13, 14 as it is forced aft into the tunnel. This serves to raise the hull even farther out of the water.

The shape of the tunnel between the twin sponsons 10 and the central subhull 12 also gives rise to venturi effects that tend to suck the mid-section of the hull into the water even as the sponsons are being lifted out of it. It will be noted that the side walls 21 of the subhull 12 and the inboard surfaces 13, 14, 15, 16 of the sponsons converge gradually toward the point 26 located slightly less than one-half of the hull length from the bow and then diverge abruptly. (FIG. 1). This results not only in a substantial lifting effect on the fore and aft sides of the throat 26 but also in the exertion of a downward force on the hull at the throat of the venturi. Since the throat 26 is substantially midway between the bow and the stern, this tends to stabilize the attitude of the boat as has been found empirically and described hereinabove. With little change of attitude during the transformation to a planing mode, the craft literally skims across the water's surface, with only a few inches of the aft part of the hull submerged. This allows the boat to move forward without pushing vast quantities of water aside so that it can attain surprising speeds at low power.

Rearward of the underside 18 of each sponson, the water is channeled to a forward spoiler 41 which is employed to reduce drag. Each spoiler 41 comprises two pairs of chine lines 51, 54; 53, 52 which diverge rearwardly and away from each other from the aft-ends of the forward keel edges 28, 29, respectively, with the lines 52 and 54 intersecting to form a V shaped structure, the apex of the V being situated rearwardly of the edges 28, 29. When water flows past the spoilers 41, a turbulent flow is enhanced; and vortices are formed that tend to trap air bubbles in the flow pattern. This entrained air reduces the surface tension of the water and thereby decreases the drag forces on the hull. The presence of air bubbles aft of the spoilers 41 in an escape passageway or spoilage tunnel has been observed in test runs on a prototype.

Aft of the spoilers 41, the inboard surfaces 13, 14 and the side wall 21 merge with the ceiling 27 of the escape passageway for water disturbed by the sponsons 10 and subhull 12. This passageway runs rearwardly between the rear keel edge 23 and a turning stabilizer or anti-skid fin 42. Extending generally parallel to the flow of water past the undersides 18 of the sponsons but offset toward the centerline of the hull, each fin 42 is positioned so that its fore-end directs part of the water passing through the tunnel between the subhull 12 and the sponsons 10 as well as some of the water flowing past the proximate underside 18 into the escape passageway. Moreover, the fore-end of each fin 42 is located so that it protrudes from a generally flat, slightly inclined section of the hull and is situated generally midway between the chine line 24 on the bottom wall 20 and the chine line 51. From this position, the fin 42 tapers away from the centerline of the hull towards the rearwardly facing step 17 and terminates aft of it at a shallow spoiler 62. The fin 42 functions not only to channel water away from the stern so that the boat is "dry running" but also to give the hull directional stability when it is planing and to prevent it from sliding sideways when it is making a turn of short radius. By way of example, a full-size test boat measuring 24 feet from bow to stern and employing my hull turns in 50 feet to 40 mph. The rearward spoilers 62 at the aft-end of the fins 42 each include two chine lines 71, 72 which diverge from each other and extend rearwardly. The amount of drag which would otherwise be present is reduced as water flowing along the fins 42 traverses the spoilers 62 by a mechanism similar to that which occurs as the flow passes the forward spoilers 41. In addition, since the rearward spoilers 62 are aft of the maximum beam of the hull, they are in a region where the flow tends to separate from the surface of the hull. They serve to trip the flow, bringing it back to the generally flat underside of the aft part of the hull. This helps to straighten the flow as it enters the propeller (not shown), increasing the blade efficiency.

The bottom wall 20 which extends forward from the transom wall 19 and which remains generally flat for approximately one-half the length of the hull serves as both a planing surface and to further straighten and smooth the flow as it enters the propeller. The rear keel edges 23 on either side of the wall 20 protrude downwardly from it a distance of approximately ¼ inch. The edges 23 eliminate propeller cavitation which was found to occur upon testing a prototype hull otherwise similar to the preferred embodiment but having the edges 23 and the bottom wall 20 replaced with an extremely shallow V-shaped section, the cavitation occurring when the prototype hull was weighted down with six or seven people. In the case of the preferred hull, the flow into the propeller is sufficiently smooth even when the outboard motor is tilted.

Moreover, with the latter hull, it is very easy to lift the forward section out of the water by either or both an increase in speed or the tilting of the outboard motor. Thus the attitude of the craft can be adjusted to accomodate water conditions. The high, stable lift capability of the hull aids in its being able to easily handle wakes or waves and to even bridge ocean swells. Moreover, the hull has a very short recovery time after traversing a wake in any direction, exhibiting only one oscillation in a situation in which most boats would continue to rock for some time. The capability of the hull to so recover comes into effect as the boat starts to move and improves with increased speed unlike conventional boat hulls which tend to become more unstable. The wide track between the sponsons 10 allows them to function as outriggers to stabilize the hull as does the suction force operating at the venturi throat 26 when the hull is in a planing mode at the same time the dual antiskid fins 42 which diverge rearwardly from each other and from the rear keel edges 23 tend to dampen out a wake. Further, the hull can take heavier water without experiencing a pounding effect because its forward section traps cushioning air between the water, the bridging structure 11, the fore part of the central subhull 12, and the sponsons 10 to dampen the effects of rough water.

A full-size prototype, the deck of which resembles that of a 28 foot pontoon-type boat (in which the pontoons protrude fore and aft two feet) and which is powered by a 200 hp motor has been used alternately for carrying up to seventeen people at 36 mph and for towing two slalom skiers with thirteen people aboard. The optimum speed for this boat so powered is over 50 mph with two people aboard. In addition, it can be powered by only a 50 hp motor and still attain a planing mode. Such performance is believed to be superior to any other boat of its size and power class.

A further important feature of a boat with my hull is its trailering capability. Not only can this boat be driven under its own power onto a trailer but also the various concave surfaces on the underside of the hull serve as ideal sites on which to rest it when it is being transported. For a full-size prototype, only two pairs of skids (padded 2×4's) and two nylon straps were required to support and hold the boat securely on a trailer.

What is claimed is:

1. A boat hull comprising twin forward subhulls, a structure bridging therebetween, a central subhull having its fore-end juxtaposed between the forward subhulls and positioned upwardly from the points at which the twin forward subhulls have their maximum depth, and a pair of stabilizing fins, each of which is formed in the hull aft of a forward subhull and which extends rearwardly to a step; a fore part of the central subhull and the twin forward subhulls forming a pair of venturi throats, these throats reaching a minimum cross-sectional area at approximately one-half the hull length; the forward subhulls terminating generally midship and proximate said minimum cross-sectional area; the central subhull having a pair of upper walls and a transversely flat bottom wall, the upper walls sloping upwardly and outwardly from the bottom wall; a front portion of the bottom wall being forwardly and upwardly inclined towards the fore-end of the central subhull; said bottom wall, forward of said minimum cross-sectional area, terminating in substantially a point; the bottom wall extending rearwardly of said point to the stern of the boat, the greatest width of the bottom wall being approximately equal to the narrowest separation between the forward twin subhulls; the bottom wall serving both as a planing surface and to straighten and smooth the flow as it enters the region which a propeller occupies in use; each forward subhull having a modified W cross-sectional form which terminates downwardly in a pair of forward keel edges; the pair of forward keel edges for each forward subhull bounding a concave underside and being disposed approximately parallel to the longitudinal axis of the hull; each of the stabilizing fins extending rearwardly from a point aft of one of the forward subhulls, the fore-end of each fin being offset generally from the longitudinal centerline of the concave underside of the proximate forward subhull toward said longitudinal axis and diverging rearwardly therefrom, each fin extending generally one-half the distance from the forward subhull to the stern of the boat and terminating rearwardly of said step; the span of the hull being reduced substantially at the step to decrease the water contact surface in the aft part of the hull; the central subhull forming a pair of spoilage tunnels, each tunnel being disposed between one of the stabilizing fins and the bottom wall; the two venturi throats being positioned to direct flow therethrough into the spoilage tunnels; rearwardly of the step, the central subhull forming a pair of generally flattened side walls which are inclined upwardly with respect to the bottom wall and which extend outwardly therefrom; the hull exhibiting a smooth transition from rest to a planing mode, the capacity to recover quickly after traversing a wake and stability during tight turns at high speeds.

2. A boat hull according to claim 1 wherein the hull further comprises a pair of shallow rear keel edges bounding a substantial portion of the bottom wall extending to the stern, the pair of generally flattened side walls extending upwardly and outwardly from the rear keel edges and a pair each of forward and rearward spoilers, each forward and rearward spoiler being situated at the fore-end and at the aft-end, respectively, of a stabilizing fin; the spoilers tripping the flow across the the aft part of the hull, causing increased turbulence which aids the flow to follow the surfaces of the aft part in contact with the water, so that the aft part rides on a film of air-entrained water, greatly reducing the drag of the hull; the rear keel edges further straightening the flow, thereby adapting it to feed smoothly and parallel to the longitudinal axis of the hull into a propeller at the stern of the boat, thereby increasing its performance and motor efficiency.

3. A hull for a boat capable of lifting its forward section out of the water and planing on its rear section at low speeds, comprising:

(a) twin forward subhulls each having a modified W cross-sectional form including outboard and inboard surfaces which terminate downwardly in a pair of forward keel edges and a concave underside bounded by the forward keel edges; the pair of keel edges for each forward subhull being disposed approximately parallel to the longitudinal axis of the hull; the concave underside extending forwardly above the load water line of the hull and forming a channel into which air is forced aft beneath the forward subhull to provide lift to the forward section whenever the forward keel edges are in contact with the water and the boat is moving forward; the channel being free from projections thereinto and having an approximately uniform cross-sectional area throughout the mid-section of the forward subhull, so that the rate at which air is forced aft remains generally independent of the leading edge at which the forward subhull contacts the water as the leading edge progresses along said mid-section towards the stern, thereby enhancing the smooth, kickless take-off of the hull which is exhibited as it begins to plane;

(b) a structure bridging between the subhulls and forming a central tunnel therewith, the structure having a pair of side walls forming a V section which protudes downwardly, partially dividing the tunnel, and a transversely flat bottom wall which is forwardly and upwardly inclined towards said V section and which, bounded by the lower edges of the side walls, terminates in substantially a point proximate the aft-end of said V section; the side walls sloping generally outwardly and upwardly at increasingly smaller angles to the horizontal rearwardly of said point; the bridging structure and the forward subhulls forming a pair of venturi throats, these throats reaching a minimum cross-sectional area at approximately one-half the hull length; the forward subhulls terminating generally midship and proximate said minimum cross-sectional area, the concave undersides of the forward subhulls gradually flattening out at the same time the tunnel flattens rearwardly of said point and is divided to form the pair of venturi throats; the bottom wall extending rearwardly to the stern of the boat, the greatest width of the bottom wall being approximately equal to the narrowest separation between the forward subhulls; the bottom wall serving both as a planing surface and to straighten and smooth the flow as it enters the region which a driving propeller occupies in use; the tunnel being adapted to entrap air when the boat starts to move, with the air flowing past the upper portions of the side walls of the tunnel as water flows beneath the bottom wall thereof; the general flattening of the walls of the tunnel rearwardly of said point bringing the air into intimate contact with the flowing water and entraining air bubbles in it;

(c) a pair of substantially flat side wall sections which are inclined upwardly with respect to the bottom wall and which extend outwardly therefrom rearwardly of the forward subhulls to reduce the water contact area; and (d) a pair of spoilers on either side of the bottom wall near the mid-section of the hull, the spoilers tripping the flow passing beneath the concave undersides of the forward subhulls as the hull begins to move forward and spreading the flow across most of said aft part of the hull, so that the aft part rides on a film of air-entrained water, greatly reducing its drag; the hull being lifted in the water by forces exerted by air forced aft in both the tunnel and the channels but undergoing only a small change of attitude while attaining a planing mode, so that the hull can move forward without pushing vast quantities of water aside.

4. A boat hull according to claim 3 which further comprises the aft part having a pair of stabilizing fins, each of which acts as a rudder to aid in dampening out wave motion and in reducing sideways skidding of the hull in tight turns while the boat is planing; each of the stabilizing fins diverging rearwardly from the longitudinal axis of the hull, thereby facilitating the channeling of water flowing beneath the hull away from the mid-section of its stern.

5. A boat hull according to claim 4 which further comprises a pair of shallow rear keel edges bounding a substantial portion of the bottom wall and extending to the stern of the boat, the pair of flat side wall sections extending upwardly and outwardly from the rear keel edges; the rear keel edges further straightening the flow, thereby adapting it to feed smoothly and parallel to the longitudinal axis of the hull into the driving propeller even when the boat is making a steep turn.

* * * * *